US005259420A

United States Patent [19]

Foster

[11] Patent Number: 5,259,420

[45] Date of Patent: Nov. 9, 1993

[54] UPPER WARP BEAM SUPPORTING ASSEMBLY AND METHOD

[76] Inventor: Harry L. Foster, 165 Timberlake Cir., Inman, S.C. 29349

[21] Appl. No.: 15,591

[22] Filed: Feb. 10, 1993

[51] Int. Cl.[5] ..... D03D 49/06

[52] U.S. Cl. ..... 139/97; 139/102; 242/58

[58] Field of Search ..... 28/190, 192; 139/24, 139/101, 102, 97, 25, 26; 29/401.1; 242/58

[56] References Cited

U.S. PATENT DOCUMENTS

| | | | |
|---|---|---|---|
| Re. 17,934 | 1/1931 | Moore | 139/101 |
| 811,358 | 1/1906 | Baer . | |
| 1,468,576 | 9/1923 | Remington et al. . | |
| 2,738,565 | 3/1956 | Robertson et al. . | |
| 2,823,530 | 2/1958 | Rikard | 139/101 X |
| 3,302,665 | 2/1967 | McHargue . | |
| 3,853,287 | 12/1974 | Scholze et al. | 139/101 X |
| 4,112,981 | 9/1978 | Freisler | 139/25 X |
| 4,579,151 | 4/1986 | Mohelnicky et al. . | |
| 5,031,666 | 7/1991 | Raaijmakers et al. . | |
| 5,033,173 | 7/1991 | Hagewood . | |
| 5,046,224 | 9/1991 | Bogucki-Land et al. . | |

*Primary Examiner*—Andrew M. Falik

*Attorney, Agent, or Firm*—Leatherwood Walker Todd & Mann

[57] ABSTRACT

A method and apparatus for supporting upper warp beams of a loom wherein adjustable central support structures are provided for supporting upper warp beams of increased capacity. End supports are provided for allowing offset of the warp beams to accommodate larger drive gears. The combination of the end supports and adjustable central support system increases safety of supporting the upper warp beams and also allows use of upper warp beams of equal size to the lower warp beams. This allows for the loom to run significantly longer prior to change out of the upper warp beams.

15 Claims, 5 Drawing Sheets

UPPER WARP BEAM SUPPORTING ASSEMBLY AND METHOD

BACKGROUND OF THE INVENTION

The present invention relates to a method and apparatus for supporting the upper warp beams of a conventional loom, and in particular, for supporting upper warp beams of increased capacity.

A constant goal in industry is to increase production. The textile industry is no exception. In the textile industry, automated looms are used to produce woven goods. A conventional loom typically includes a series of warp yarns extending perpendicularly to the loom frame and a series of filling yarns which are carried back and forth parallel to the loom frame in the forming of a woven product. The woven product is then taken up on a take-up, or cloth, roll.

The warp yarns are delivered from cylindrical rolls known as warp beams. Warp beams are carried for rotation by the loom frame and are slowly rotated as the warp yarns are payed out from the warp beam. The warp beam typically has hundreds of individual warp yarns running its length, each of the warp yarns being wound on the warp beam individually, in a side by side fashion. Devices for winding the warp yarns have been patented and are disclosed, for example, in U.S. Pat. No. 5,046,224, issued Sep. 10, 1991, to Bogucki-Land, et al; U.S. Pat. No. 5,033,173, issued Jul. 23, 1991 to Hagewood; U.S. Pat. No. 5,031,666, issued Jul. 16, 1991, to Raaijmakers, et al; U.S. Pat. No. 2,738,565, issued Mar. 20, 1956 to Robertson, et al; and U.S. Pat. No. 811,358, issued Jan. 30, 1906 to Baer.

Patented loom devices include U.S. Pat. No. 1,468,576, issued Sep. 18, 1923, to Remington, et al; U.S. Pat. No. 3,302,665, issued Feb. 7, 1967 to McHargue; and U.S. Pat. No. 4,579,151, issued Apr. 1, 1986, to Mohelnicky, et al.

In certain applications, it is advantageous to provide upper warp beams to a loom, in addition to the warp beams normally carried adjacent the base of the loom. The use of the additional upper warp beams is common with making woven products such as terry cloth, a patented terry fabric method being discussed by the U.S. Pat. No. 3,302,665.

A problem arises with the supporting of upper warp beams on the loom. Because of their weight, the upper warp beams are typically of a smaller diameter, and thus lighter than, the lower warp beams in order to ensure adequate support of the upper warp beams is possible. Because such warp beams are smaller than the lower warp beams, and accordingly have less capacity, the need of changing the upper warp beams more frequently than the lower warp beams is necessitated, resulting in increased downtime of the machine, increased labor costs, and corresponding productivity decreases. As an example, the Sulzer-Ruti Model 153 loom exhibits this problem. However, this problem could potentially exist wherever upper warps beam are added to a loom.

Other problems exist with adding upper warp beams to a loom. For example, when at least two upper warp beams are added, a center support is required between the two upper warp beams, which not only acts as a support but also acts as a bearing surface for the shafts on which the upper warp beams are supported. Because the ends of the warp beams must be relatively close together due to the operational constraints of the loom, the space provided between the ends of the warp beams is small. Correspondingly, the support and bearing surfaces located between the ends of the upper warp beams must also be of a low profile. Accordingly, problems have arisen in that such supports have not been adequate to simultaneously support the upper warp beams adequately for preventing bending and sagging of the beams in the mid-portion of the loom and also for adequately constraining the beams from outward longitudinal movement during rotation.

In some instances the upper warp beams have actually fallen from the central supports during operation, thereby creating a serious safety hazard, in addition to potentially damaging the loom and other machinery and causing production losses.

SUMMARY OF THE INVENTION

In view of the foregoing, it is an object of the present invention to provide a method and apparatus for safely supporting upper warp beams of a loom.

It is another object of the present invention to provide means for supporting upper warp beams on a loom which have warp yarn capacities at least equal to that of the lower warp beams of the loom.

It is another object of the present invention to provide means for compensating for bending along the lengths of the upper warp beams.

It is still another object of the present invention to provide means for supporting upper warp beams of different lengths.

It is yet another object of the present invention to provide means for reducing the downtime of a loom.

It is still another object of the present invention to provide an adjustable means for supporting two adjacent upper warp beams.

These and other aspects of the present invention will become further evident upon reference to the following description and accompanying drawings.

To generally summarize the present invention, one preferred embodiment includes a warp beam support assembly attachable to a loom for supporting for rotation at least two upper warp beams of the loom by the shaft ends, or bearings, thereof. The loom is of the type having a base portion and an upstanding frame portion connected thereto, and at least two lower warp beams supported by lower warp beam shaft ends, the loom also having first, second and central upper and lower bearing housings connected to the loom frame for rotatably supporting the upper and lower warp beam shaft ends.

The warp beam support assembly includes first and second end supports, each of the first and second end supports being elongated and having a first end and a second end opposite the first end. The first end is connectable to the frame of the loom and the second end is connectable to one of the first and second bearing housings. The first and second end supports extend upwardly and outwardly from the frame of the loom for attachment to the first and second bearing housings, respectively.

Central support means are provided which are connectable to the central bearing housing for supporting the central bearing housing. The central support means includes an elongated first central support member with a first end and a second end opposite the first end. The first end of the first central support member is connectable to the lower bearing housing, and the second end of the first central support member is connectable to the upper central bearing housing. Also, the first end of the first central support member is preferably connectable to the lower central bearing housing for selective pivotal movement relative thereto.

First central support adjustment means connected to the first central support member are provided for selectively lengthening and shortening the first central support member for varying the distance between the first and second ends of the first central support member.

Additionally, the central support means preferably includes lateral adjustment means for selectively allowing the central support means to move laterally with respect to the loom frame to accommodate warp beams of different widths and to accommodate different weave widths of the loom.

BRIEF DESCRIPTION OF THE DRAWINGS

The foregoing, as well as other objects of the present invention, will be further apparent from the following detailed description of the preferred embodiment of the invention, when taken together with the accompanying drawings, in which.

DESCRIPTION OF THE PREFERRED EMBODIMENT

Figure 1:
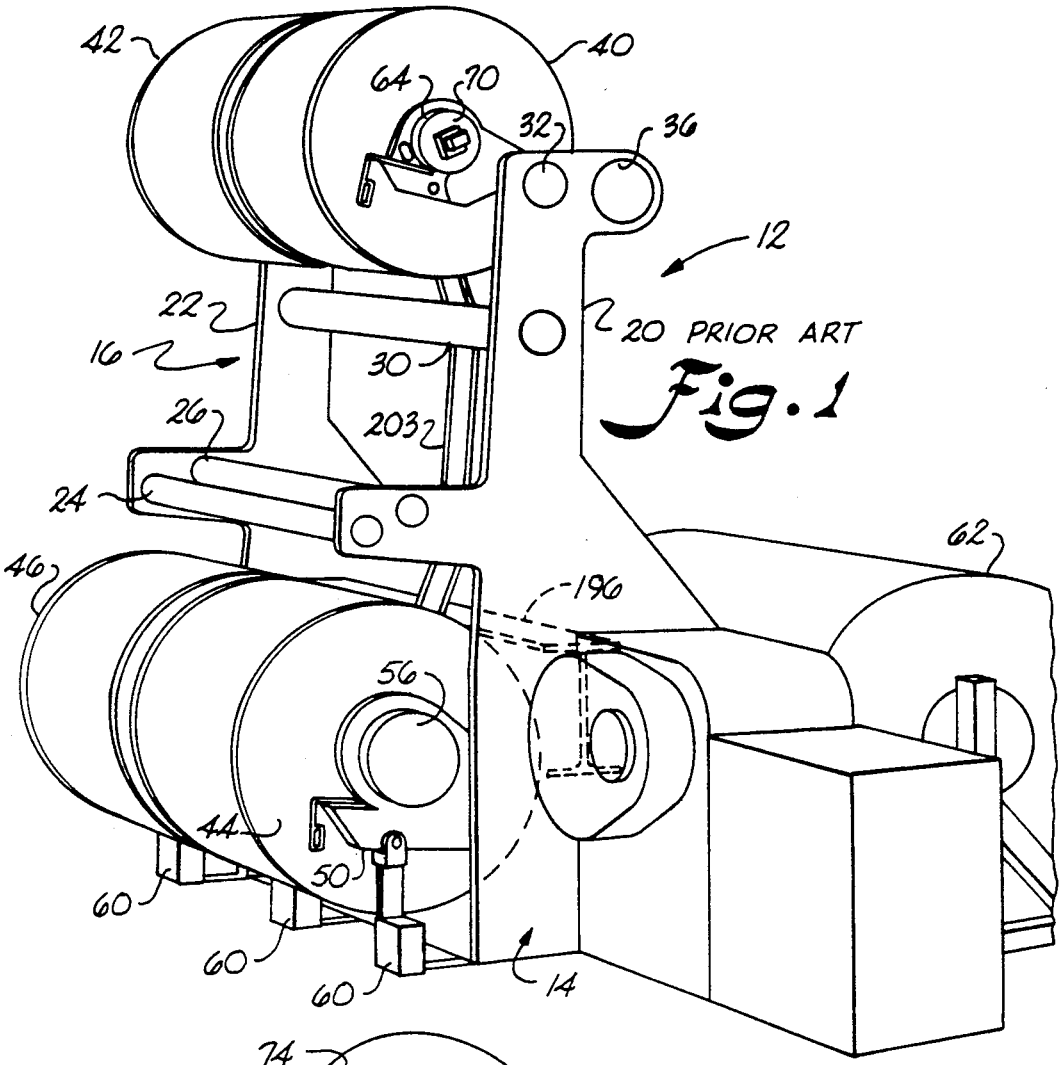
PRIOR ART Fig. 1
FIG. 1 is a perspective view of a prior art loom having the upper warp beams supported in a conventional manner.

Referring to the drawings in detail, wherein like reference characters represent like elements or features throughout the various views, the apparatus for supporting warp beams disclosed by the present invention is designated generally in the figures by reference character 10.

In FIG. 1, a conventional loom, generally 12, such as the Sulzer-Ruti Model No. 153 Loom, is illustrated having a base portion 14 and an upstanding frame portion, generally 16, connected to base portion 14. Frame 16 includes spaced apart vertical frame members 20, 22 having horizontally disposed support rails or tubing 24, 26, 30, 32, and 36.

Figure 3:
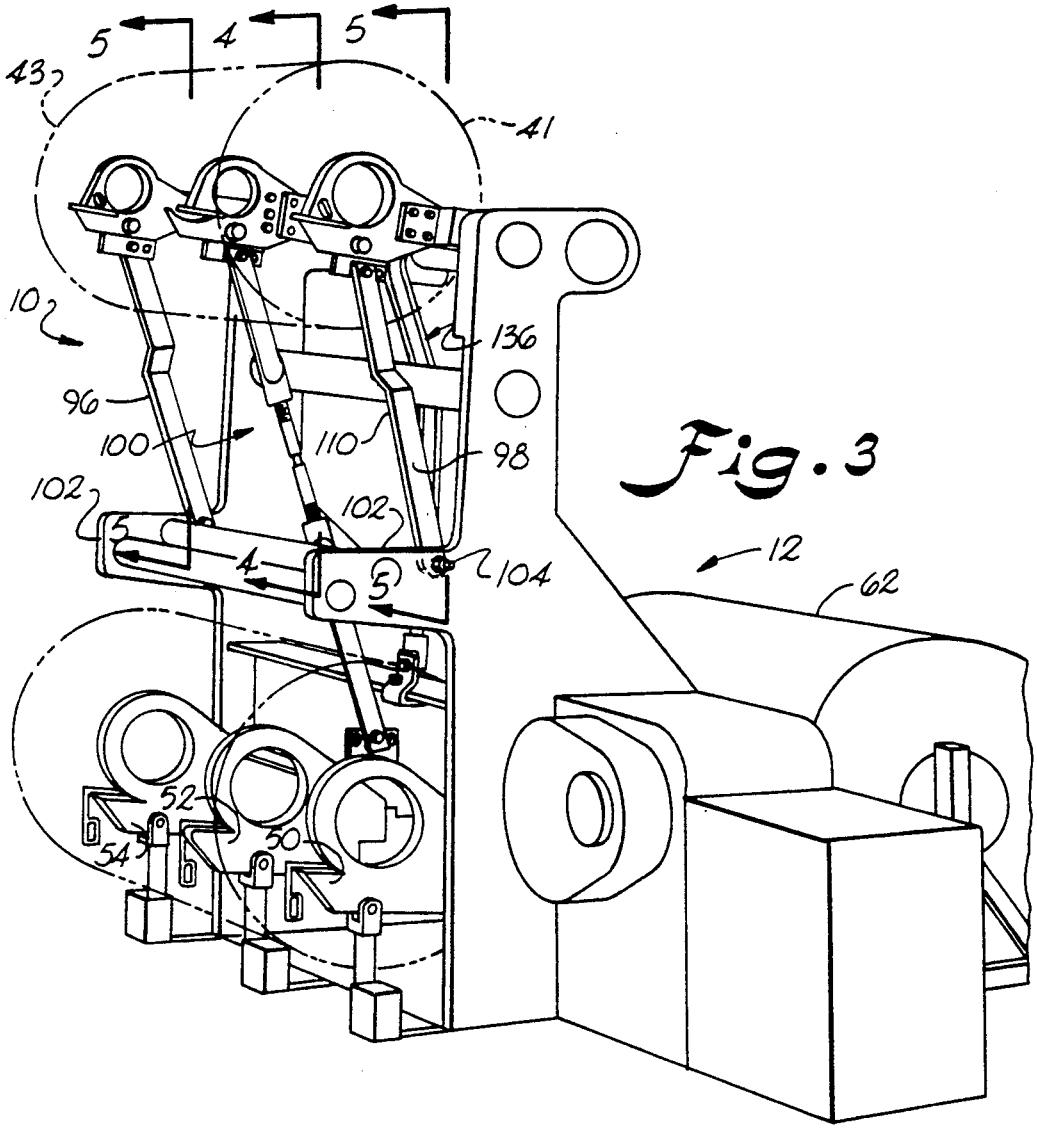
FIG. 3 is a perspective view of a loom having an upper warp beam support assembly constructed in accordance with the present invention.

Loom 12 includes upper warp beams 40, 42 and lower warp beams 44, 46, on which warp threads, or yarns, are carried for use by loom 12 during weaving. Lower warp beams 44, 46 are supported in lower bearing housings 50, 52, 54, as shown in FIG. 3, and support the lower warp beam shaft ends, or bearings, 56, one bearing housing being provided for each lower warp beam 44, 46. Lower bearing housings 50 and 54 support the outermost, or outboard, bearings of lower warp beams 44, 46, and central warp bearing housing 52 supports the inboard ends of lower warp beam shaft 56. In other words, central lower bearing housing 52 supports two bearings, or shaft ends, while lower bearing housings 50, 54 each support only one shaft end. Lower bearing housing supports 60 are connected to lower bearing housings 50, 52, and 54 for providing additional support to such housings and to lower warp beams 44, 46, when in place. In the loom depicted in FIG. 1, lower warp beams 44, 46 are known as 940 millimeter beams, meaning that when wound with warp yarns, the diameter of the amount of warp yarns wound on the beam is approximately 940 millimeters. However, the upper warp beams 40, 42 in FIG. 1 are of smaller diameter than lower warp beams 44, 46, and are only designed to withhold an accumulated diameter of 800 millimeters of wound on warp yarns. Loom 12 also includes a take-up, or cloth, roll 62 for taking up woven material. The specific operation of loom 12, other than the supporting for rotation of the warp beams, is of conventional design and operation and can be of the type manufactured by Sulzer-Ruti, as Model 153. Therefore, the structure and operation of the loom need not be discussed in detail.

Figure 2:
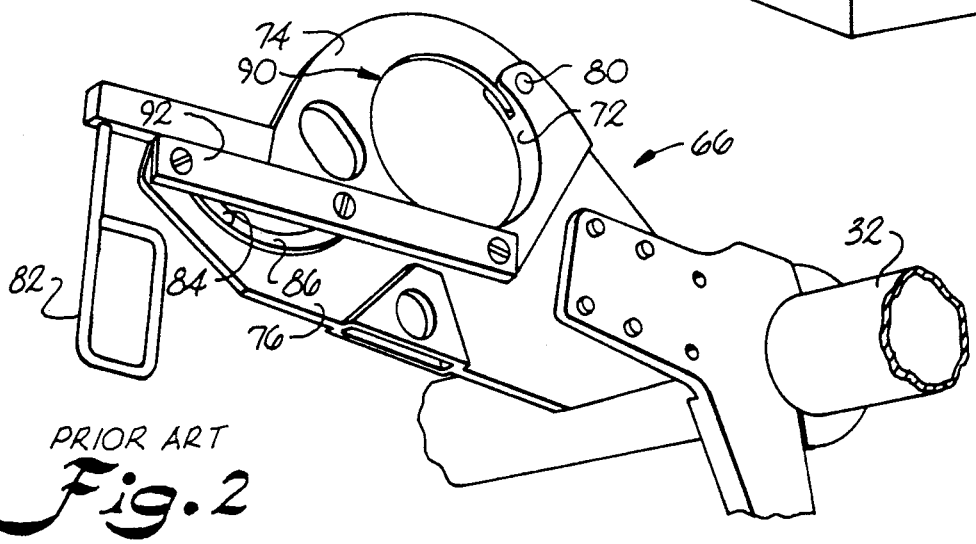
PRIOR ART Fig. 2
FIG. 2 is a partial perspective view of a prior art bearing housing for supporting the ends of two upper warp beams.

Upper warm beams 40, 42 are supported for rotation in the conventional loom 12 illustrated in FIG. 1 by outboard upper bearing housings 64 (only one shown in FIG. 1), and an upper central bearing housing, generally 66, illustrated as prior art in FIG. 2. As set forth above, several problems exist with the conventional support of upper warp beams 40, 42 by a loom such as loom 12. For example, 940 millimeter warp beams cannot be used, as they are too large to be held by the conventional bearing housing 64, 66. Also, even the supporting of 800 millimeter upper warp beams is not entirely satisfactory with the conventional bearing housings 64, 66, in that the upper warp beams tend to bend, or sag, at upper central bearing housing 66. While this sagging of the upper warp beams can potentially reduce operational efficiency, more seriously, a safety hazard can arise in the event that the sagging becomes so great that the inboard ends of upper warp beam shaft ends, or bearings, 70 actually lose contact with the bearing surface 72 of upper central bearing housing 66, which may cause one or both of upper warp beams 40, 42 to fall from loom 12, thereby creating a dangerous situation for personnel and equipment, and also resulting in production losses.

Upper central bearing housing 66, illustrated in FIG. 2, includes a pivotal clamping portion 74 which pivots about a lower portion 76 in clamping of a warp beam shaft end to the bearing housing 66. Clamping portion 74 pivots about a pin 80 when handle 82 is pulled downwardly or pushed upwardly. When handle 82 is pulled downwardly, a finger 84 is received within a curved passage 86, defined in lower portion 76. The engagement of finger 84 in curved passage 86 is generally sufficient to retain a shaft end, or bearing, against upward movement and within shaft receiving opening 90 adjacent bearing surface 72. A side plate, or rail 92, is sometimes attached to each side of lower portion 76 to serve as a retaining device to prevent a warp beam bearing 70 from dislodging from bearing surfaces 72.

An upper warp beam support system, generally 10, constructed in accordance with the present invention, is illustrated in FIG. 3. Generally, the present invention includes first and second end supports 96, 98 and central support means, or structure, generally 100. End supports 94, 96 are preferably constructed of steel and/or ductile iron, and span between lateral members 102 provided on each vertical frame member 20, 22 of frame 16. End supports 96, 98 each include attachment means, such as a bolt, screw, pin, or the like for attaching the end support to the respective lateral member. The use of nuts and bolts, generally 104, are shown for illustrative purposes only. Any other suitable fastener could also be used.

Because the structure and operation of end supports 96, 98 are substantially identical, only end support 96 will be described in detail. End support 96 extends upwardly and outwardly from lateral member 102 and includes a bridging portion 110 connecting a first portion 112 of end support 96 to a second portion 114. Second portion 114 includes an opening in which a pin or bolt 120 is received. Bolt 120 connects second portion 114 to an adaptor device 122, which is provided within a recess 124 of upper bearing housing 64. The adaptor 122 includes a pin 126 received within an opening 130 running transversely through recess 124 of upper bearing support 64. Adaptor 122 includes a plurality of pin or bolt holes 131 which allow second portion 114 of end support 96 to be placed in different positions of adaptor device 122 as desired. By allowing end 106 of end support 96 to be moved with respect to bearing housing 64, the position of bearing housing 64 with respect to frame 16 of loom 12 can be varied as desired when larger capacity, 940 mm upper warp beams 41, 43 are supported by bearing housing 64. Because of the single pivotable connection of the first portion 112 of end support 96 to lateral number 102, movement of second portion 114 between the various pins or bolt holes 131 of adaptor device 122 is facilitated.

Bridging portion 110 displaces second portion 114 of end support 96 inwardly to compensate for the slight offset of bearing housing 64 from vertical frame member 20. Additionally, a one-piece spacer block 132 can be used to space bearing housing 64 inwardly and outwardly from frame member 20, and/or 22, as desired, in order to adjust the offset of bearing housing 64 to more securely and rigidly support a shaft end 94 of an upper warp beam for rotation and also to allow clearance for driving the drive gear (not shown) provided on an end of each of the upper warp beams, if necessary.

Figure 4:
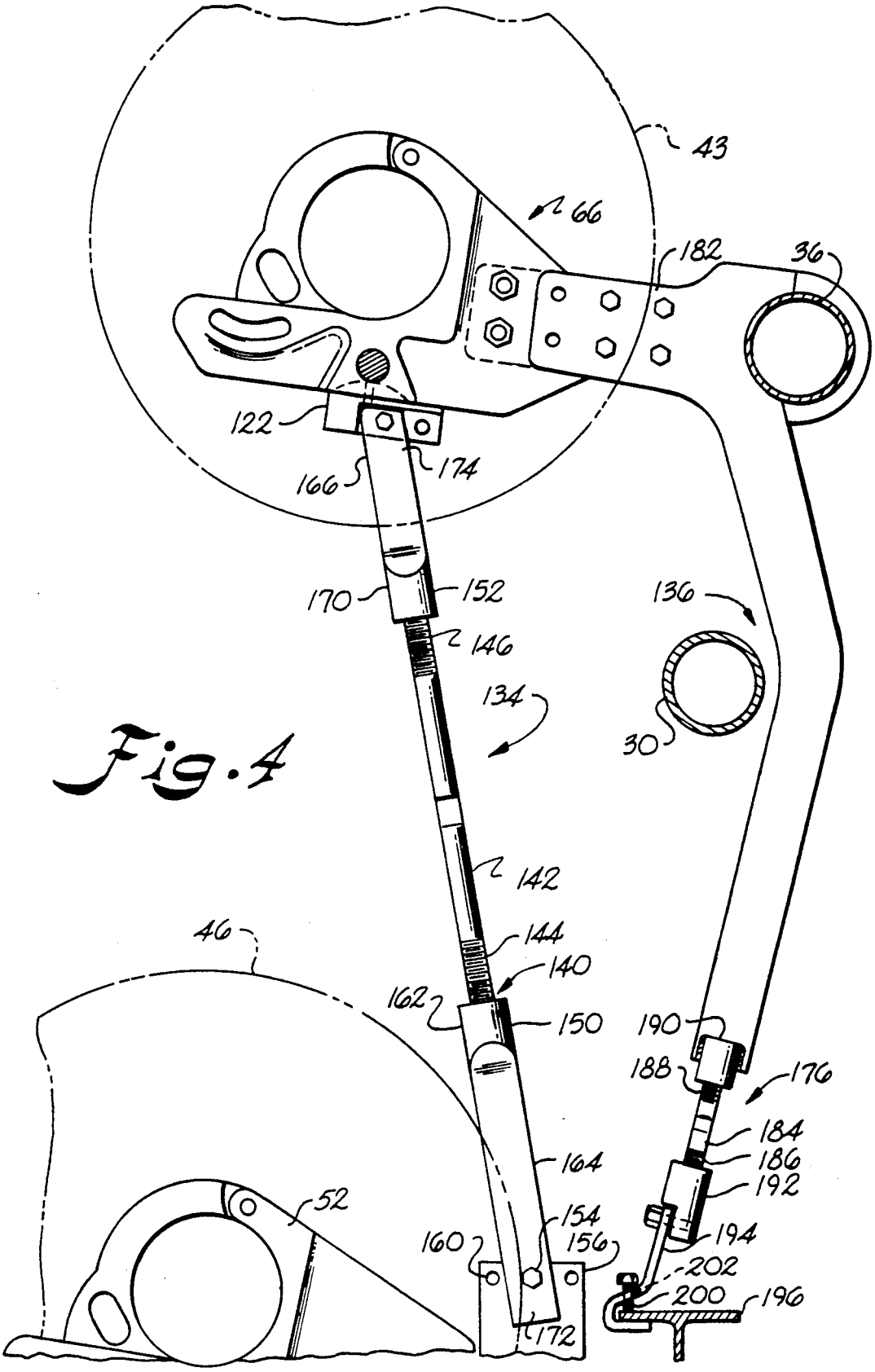
FIG. 4 is a sectional view taken along lines 4—4 of FIG. 3 of a central support assembly constructed in accordance with the present invention supporting the ends of two upper warp beams.

As shown in FIG. 4, the central support structure 100 includes two primary sub-support structures, generally 134 and 136. The first central support structure 134 includes a turnbuckle arrangement 140, which includes a threaded shaft 142 having oppositely pitched threads 144, 146 defined in each end thereof. Threadingly engaged with such threads are receiver links 150, 152. Receiver link 150 includes an opening which receives a bolt 154 or pin for pivotally connecting receiver link 150 to a bracket 156 connected to loom 12 adjacent the base 14 thereof. Bracket 156 preferably is connected to lower central bearing housing 52 by means of bolts. Bracket 156 defines several holes 160 such that receiver link 150 may be alternately positioned with respect to any of the holes 160, with pins or bolts, depending on the desired angle of receiving link 150 for supporting upper central bearing housing 66. Receiving link 150 has a substantially cylindrical end 162 and a substantially paddle shaped end 164. Paddle-shaped end 164 is of a narrowed cross section for insertion between the ends of lower warp beams 44, 46, and link 152 correspondingly has a paddle-shaped end 166 and a substantially cylindrical end 170. Paddle-shaped end 166 is for insertion between upper warp beams 41, 43. Because of the narrow clearance between upper warp beams 41, 43 and between lower warp beams 44, 46, the paddle-shaped design provides significant structural support, particularly in conjunction with the turnbuckle 140 arrangement, which uses a cylindrical shaft received in cylindrical ends 162, 170, respectively.

It is to be understood that various types of arrangements instead of turnbuckle 140 could be used to adjust the overall length between ends 172 and 174 of central Support structure 134. For example, a sliding arrangement between telescoping arms could be used with a suitable locking device, such as a set screw or the like. Also, elongated slots could be provided in links 150, 152 for a sliding, overlapping arrangement wherein bolts could be received in this slot for selectively allowing adjustment between ends 172 and 174. These are but several alternate means for allowing adjustment between ends 172, 174, with any other suitable means being usable as desired.

The second central support 136 is slidably mounted on horizontal rail 36 through engagement of an opening 180 in support 136 which receives the rail 36. Support 136 includes a mounting plate 182 which bolts to upper central bearing housing such that movement of structure 136 along rail 36 causes corresponding movement in upper central bearing housing 66.

At the other end of structure 136 is a turnbuckle arrangement 176 including a rotatable shaft 184 having opposing thread portions 186, 188 disposed thereon. A cylindrical receiver 190 is provided on structure 136 for receiving threaded shaft 184, and another cylindrical receiver 192 is provided on a bracket 194, which engages a I-beam, or transverse frame member, 196 which runs substantially from one side of loom 12 to the other. Bracket 194 is hook-shaped and engages under the underside of transverse frame member 196. A bolt 200, or other adjustable fastening means, is provided in a threaded opening 202 of bracket 194 to allow the transverse movement of support structure 136 to be selectively fixed or released. In the conventional design, an arm 203 extends from an upper central bearing housing, in front of the I-beam 196, and ties directly into a lower central bearing housing.

Lower central bearing housing 52 is also movable laterally within loom 12 such that movement of central support structure 100 and upper bearing housing 66 will cause corresponding movement of lower central bearing housing due to the connection of first and second support structures 134, 136 with bracket 156 and transverse frame member 196, respectively. Such lateral movement of the bearing housings allows for different weave widths of material being woven by the loom to be accommodated by the warp beam supports. Further, the adjustability provided by holes 160 on bracket 156 and the different positions allowed by adapter device 122, central support structure 100, as well as first and second end supports 96, 98 can be adjusted to give clearance to a whip roll (not shown), if necessary, depending on the displacement of the whip roll.

Figures 5, 7:
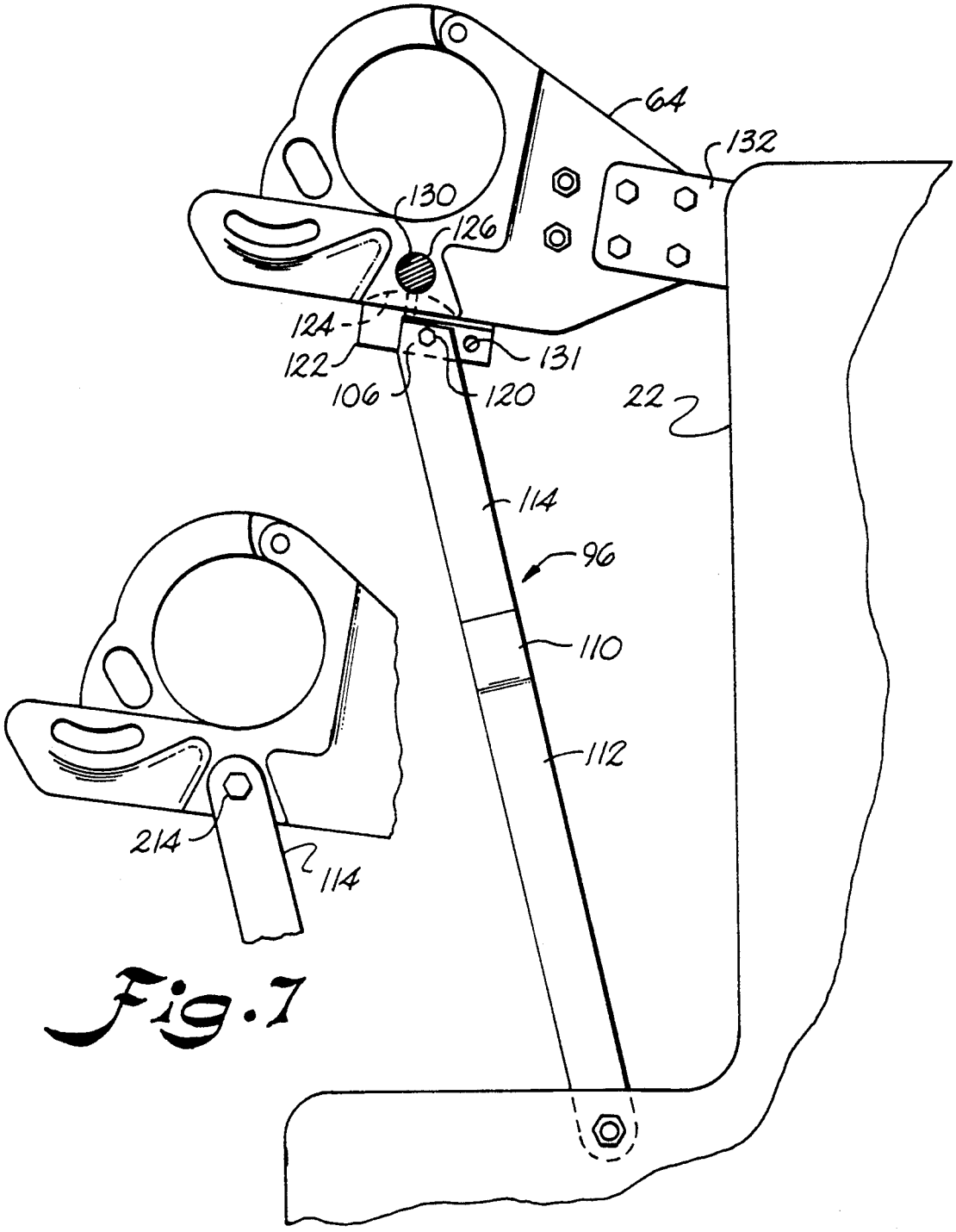
FIG. 5 is a sectional view taken along lines 5—5 of FIG. 3 of an upper warp beam end support constructed in accordance with the present invention.
FIG. 7 is a partial side elevational view of an alternate embodiment of a upper warp beam end support constructed in accordance with the present invention.
Figure 6:
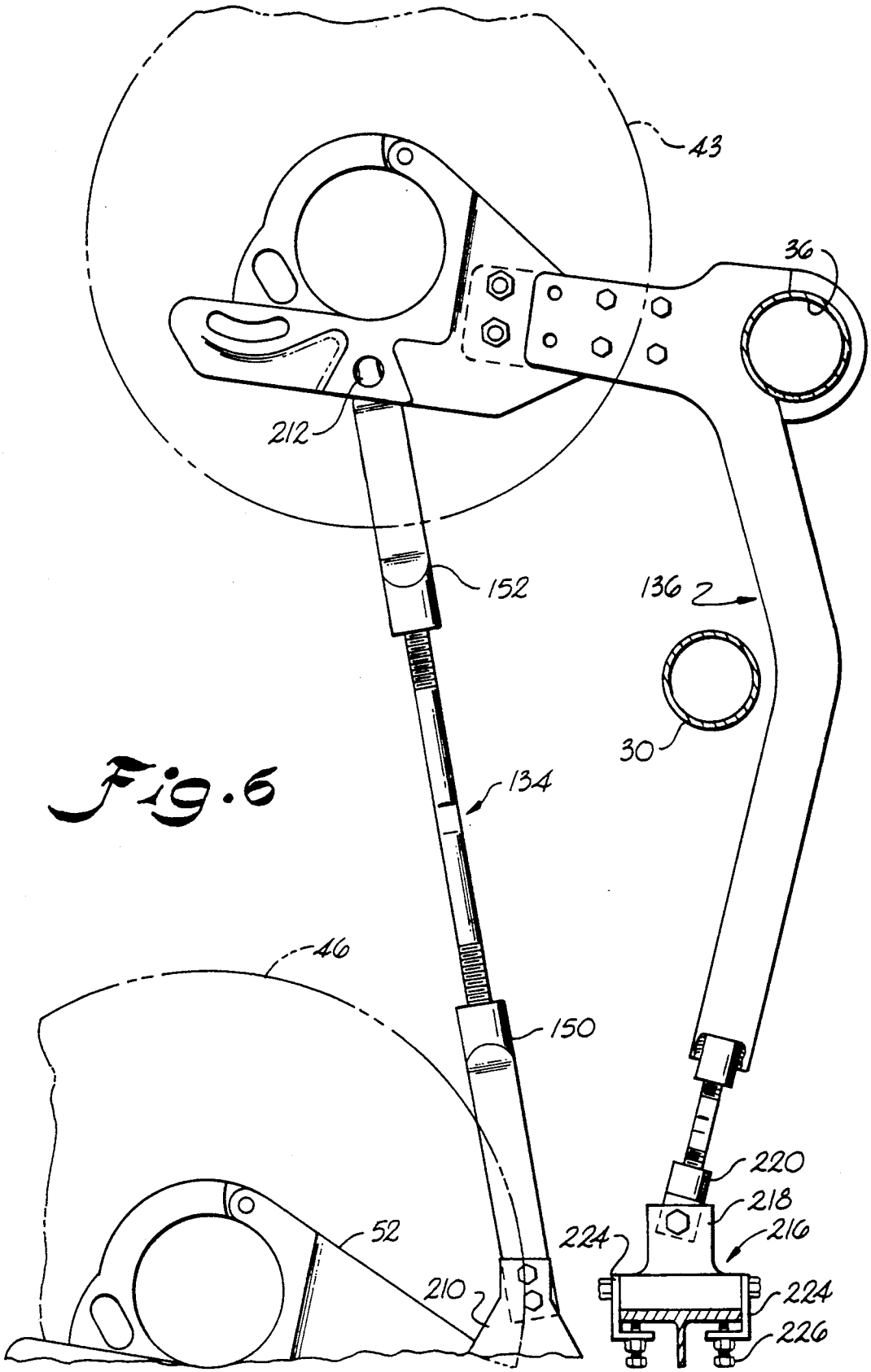
FIG. 6 is a partial side elevational view of an alternate embodiment of a central support assembly for supporting two upper warp beams constructed in accordance with the present invention.

FIGS. 6 and 7 illustrate an alternate embodiment of the present invention. A simplified bracket 200 is used instead of bracket 156, with bracket 210 having only one position for attachment by receiver 150. Also, instead of use of adaptor 122, the end of receiver 152 is inserted directly into recess 124 of the upper central bearing housing, with a projection 212 being provided on the end of receiver 152 for insertion into recess 124. As shown in FIG. 7, the end supports may have an end 214 thereof bolted directly to a hole existing in the bearing housing instead of connecting to an adaptor such as device 122.

The second support 136 may include a modified bracket for attachment to transverse member 196, such as a bracket, generally 216, connected to turnbuckle 176 through boss 218 and receiver 220. Bracket 216 includes a base 222 which engages with transverse frame member 196 by means of engagement arms 224, which are bolted or otherwise attached to bracket 216. Bolts 226, or other suitable fasteners, selectively fix bracket 216 to member 196 to restrain lateral movement of the central support assembly when such fixation is desired.

In operation, the central bearing housing 66 can be readily adjusted through rotation of shaft 142 of turnbuckle 140, to eliminate sagging of the upper warp beams. By eliminating sagging of the upper warp beams, the potential for the warp beams working free of upper central bearing housing 66 is greatly reduced. Also, of primary significance is the ability of the present invention to support upper warp beams of 940 millimeters, thereby allowing the upper warp beam capacity to equal the capacity of the lower warp beams. This results in substantial savings in that the loom runs for a significantly longer period of time prior to requiring the change out of the upper warp beams. Further, reduced labor costs and reduced down time of the loom may be realized in that the upper and lower warp beams can be changed less frequently. If desired, upper warp beams of greater or less capacity than the lower warp beams could also be supported by the warp beam supporting assembly constructed in accordance with the present invention.

The present invention also concerns a method for increasing the productivity a loom through the replacement of existing upper warp beams with warp beams of higher capacity. The higher capacity upper warp beams would match the capacity of the lower warp beams, thereby allowing the upper and lower warp beams to be changed with the substantially the same frequency, instead of requiring the upper warp beams to be changed more frequently than the lower warp beams. Of course, the method could also be used to support upper warp beams of greater or less capacity than the lower warp beams, if desired.

The method would entail removing the existing upper warp beam bearing housings and replacing them with bearing housings of the construction as discussed above. End supports are also provided for the outboard upper bearing housings and would be connected to the frame of the loom. The end supports preferably would extend up and away from the loom to tie the outboard bearing housings to the loom in a substantially triangular frame configuration.

Central supports for the upper central bearing housing, constructed in accordance with the present invention as discussed above, are then provided to support the inboard ends of the upper warp beams. Supporting the upper bearing housing would include adjusting the length of the central bearing support assemblies to compensate for bending along the lengths of the upper warp beams. The central support assembly would also be shifted laterally with respect to the loom to a desired position for accommodating the particular weave style being produced by the loom.

The end supports and the central supports for the upper central bearing are also pivoted with respect to the loom frame to insure that proper clearance between the upper warp beams and a whip roll is maintained, if a whip roll is to be used with the loom.

Accordingly, from the foregoing, it can be seen that the present invention provides an improved structure and method for supporting the upper warp beams of a loom.

While a preferred embodiment of the invention has been described using specific terms, such description is for present illustrative purposes only, and it is to be understood that changes and variations to such embodiment, including but not limited to the substitution of equivalent features or parts, and the reversal of various features thereof, may be practiced by those of ordinary skill in the art, without departing from the spirit or scope of the following claims.

What is claimed is:

1. In combination with a loom, a warp beam assembly for a loom for supporting for rotation at least two upper warp beams of the loom by the ends thereof, the loom having a base portion and an upstanding frame portion connected thereto, and at least two lower warp beams supported by the ends thereof, the loom also having first, second and central upper and lower bearing housings connected to the loom frame for rotatably supporting the ends of the upper and lower warp beams, the warp beam support assembly comprising:

first and second end supports, each of said first and second end supports being elongated and having a first end and a second end opposite said first end, said first end being connectable to the frame of the loom and said second end being connectable to one of the first and second upper bearing housings; said first and second end supports extending upwardly and outwardly from the frame of the loom for attachment to the first and second upper bearing housings, respectively;

central support means connectable to the upper and lower central bearing housings for supporting the central bearing housing; said central support means having an elongated first central support member with a first end and a second end opposite said first end, said first end of said first central support member being connectable to the lower central bearing housing and said second end of said first central support member being connectable to the upper central bearing housing; said first end of said first central support member being connectable to the lower central bearing housing for selective pivotal movement relative thereto;

first central support adjustment means connected to said first central support member for selectively lengthening and shortening said first central support member for varying the distance between said first and second ends of said first central support member; and said central support means including lateral adjustment means for selectively allowing said central support means to move laterally with respect to the loom frame to accommodate upper warp beams of different length and different diameters.

2. A warp beam assembly as defined in claim 1, further comprising said central support means including a generally elongated second central support means having a first end and a second end generally opposite to said first end, said second end of said second central support member being connectable to the upper central bearing housing; and said first end of said second central support member being connected to said lateral adjustment means.

3. A warp beam support assembly as defined in claim 1, wherein said lateral adjustment means includes at least one downwardly extending flange for selective sliding engagement with the loom frame and a releasable engagement member associated with said flange for selectively fixing said flange from movement with respect to the loom frame.

4. A warp beam assembly as defined in claim 2, further comprising second central support adjustment means connected to said second central support member for selectively lengthening and shortening the distance between said first and second ends of said second central support member.

5. In combination with a loom, a warp beam support assembly for a loom for supporting for rotation at least two upper warp beams of the loom by the ends thereof, the loom having a base portion and an upstanding frame portion connected thereto, and at least two lower warp beams supported by the ends thereof, the warp beam support assembly comprising:

first and second bearing housings each being connected to the frame; each of said first and second bearing housings defining a passage for receiving end portions of the upper warp beams, each said passage including a bearing surface for supporting for rotation the ends of the upper warp beams;

first and second end supports, each of said first and second end supports being elongated and having a first end and a second end opposite said first end, said first end being connected to the frame of the loom and said second end being connected to one of said first and second bearing housings; said first and second end supports extending upwardly and outwardly from the frame of the loom for attaching to said first and second bearing housings, respectively;

upper and lower central bearing housings connected to the frame, said upper central bearing housing being between said first and second bearing housings and said lower central bearing housing being positioned beneath said upper central bearing housing; said upper central bearing housing defining an upper central passage for simultaneously receiving portions of two ends of the upper warp beams, said upper central passage including bearing surfaces for simultaneously supporting for rotation of the ends of the upper warp beams; said lower central bearing housing defining a lower central passage for simultaneously receiving portions of the ends of two of the lower warp beams, said lower central passage including bearing surfaces for simultaneously supporting for rotation both of the lower warp beams;

central support means connected to said central bearing housing for supporting said central bearing housing; said central support means having an elongated first central support member with a first end and a second end opposite said first end, said first end of said first central support member being connected to said lower central bearing housing and said second end of said first central support member being connected to said upper central bearing housing; said first end of said first central support member being connected to said lower central bearing housing for selective pivotal movement relative thereto;

first central support adjustment means connected to said first central support member for selectively lengthening and shortening said first central support member for varying the distance between said first and second ends of said first central support member;

said central support means including a generally elongated second central support means having a first end and a second end generally opposite to said first end, said second end of said second central support member being connected to said upper central bearing housing; and said central support means including lateral adjustment means for selectively allowing said central support means to move laterally with respect to the loom frame to accommodate upper warp beams of different lengths; said first end of said second central support member being connected to said lateral adjustment means.

6. A warp beam support assembly as defined in claim 5, wherein said lateral adjustment means includes at least one downwardly extending flange for selective sliding engagement with the loom frame and a releasable engagement member associated with said flange for selectively fixing said flange from movement with respect to the loom frame.

7. A warp beam support assembly as defined in claim 6, wherein said releasable engagement member is a bolt.

8. A warp beam assembly as defined in claim 5, further comprising second central support adjustment means connected to said second central support for selectively lengthening and shortening the distance between said first and second ends of said second central support member.

9. A warp beam assembly as defined in claim 5, wherein said first central support adjusting means includes a rotatable first turnbuckle assembly which may be selectively rotated to lengthen and shorten said first central support member.

10. A warp beam assembly as defined in claim 9, wherein said second central support adjusting means includes a rotatable second turnbuckle assembly connected between said first end of said second central support member and said lateral adjustment means which may be selectively rotated to lengthen and shorten said second central support member.

11. A warp beam assembly as defined in claim 5, wherein portions of said first and second ends of said first central support member are of rectangular cross-section for insertion between adjacent ends of said upper and lower warp beams, respectively.

12. A warp beam assembly as defined in claim 5, further comprising means connected to at least one of said first and second end supports for offsetting said end support laterally towards the other of said first and second end supports.

13. In combination with a loom, a warp beam support assembly for a loom for supporting for rotation at least two upper warp beams of the loom by the ends thereof, the loom having a base portion and an upstanding frame portion connected thereto, and at least two lower warp beams supported by the ends thereof, the loom also having first, second and central upper and lower bearing housings connected to the loom frame for rotatably supporting the ends of the upper and lower warp beams, the warp beam support sub-assembly comprising:

central support means connectable to the central bearing housing for supporting the central bearing housing; said central support means having an elongated first central support member with a first end and a second end opposite said first end, said first end of said first central support member being connectable to the lower central bearing housing and said second end of said first central support member being connectable to the upper central bearing housing; said first end of said first central support member being connectable to the lower central bearing housing for selective pivotal movement relative thereto;

first central support adjustment means connected to said first central support member for selectively lengthening and shortening said first central support member for varying the distance between said first and second ends of said first central support member; said central support means including a generally elongated second central support means having a first end and a second end generally opposite to said first end, said second end of said second central support member being connected to said upper central bearing housing; and said central support means including lateral adjustment means for selectively allowing said central support means to move laterally with respect to the loom frame to accommodate upper warp beams of different lengths; said first ends of said second central support member being connected to said lateral adjustment means.

14. A method for supporting for rotation at least two adjacent upper warp beams on the frame of a loom used to make woven products, the upper warp beams being supported by bearing supports connected to the frame of the loom, the upper warp beams being substantially co-linear and each warp beam having an inboard end and an outboard end opposite said inboard end, the method comprising:

providing end support means for supporting the outboard ends of the upper warp beams on the frame of the loom;

moving the bearing supports for the upper warp beams to a pre-determined position away from the frame of the loom;

providing an upper central bearing housing for supporting adjacent ends of the upper warp beams for rotation;

connecting said end supports to the upper bearing housings and to the frame of the loom;

providing central support means for supporting the upper central bearing housing;

connecting the central support means to the upper central bearing housing and to the loom;

providing central support adjusting means on the central support means for selectively adjusting the length of said central support means;

inserting the respective ends of the upper warp beams in said upper central housing and said bearing housings; and selectively adjusting said central support adjusting means to compensate for bending along the lengths of the upper warp beams, such that the respective ends of said upper warp beams are substantially coplanar.

15. The method as defined in claim 14, further comprising the steps of:

providing lateral adjustment means on said central support means for allowing movement of said central support means and said central bearing housing laterally with respect to the frame of the loom;

selectively moving said central support means laterally to a predetermined position for accommodating predetermined loom weave widths; and selectively fixing said lateral adjustment means against further lateral movement.

* * * * *